US005274979A

United States Patent [19]

Tsai

[11] Patent Number: 5,274,979

[45] Date of Patent: Jan. 4, 1994

[54] INSULATING PLATE UNIT

[76] Inventor: Jui-Hsing Tsai, No. 79, Lane 374, Min Sheng St., Kui Jen Hsiang, Tainan Hsien, Taiwan

[21] Appl. No.: 994,691

[22] Filed: Dec. 22, 1992

[51] Int. Cl.[5] ..... E04B 2/00; E04C 3/00; E04C 3/30

[52] U.S. Cl. ..... 52/595; 52/405; 52/605; 52/610

[58] Field of Search ..... 52/405, 588, 592, 593, 52/595, 605, 610

[56] References Cited

U.S. PATENT DOCUMENTS

| | | | |
|---|---|---|---|
| 3,535,844 | 10/1970 | Glaros | 52/595 |
| 3,714,747 | 2/1973 | Curran | 52/595 X |
| 3,998,024 | 12/1976 | Frandsen | 52/595 |
| 4,037,377 | 7/1977 | Howell et al. | 52/595 X |
| 4,100,710 | 7/1978 | Kowallik | 52/595 X |
| 4,104,840 | 8/1978 | Heintz et al. | 52/595 X |
| 4,107,892 | 8/1978 | Bellem | 52/595 X |

*Primary Examiner*—Neill R. Wilson

*Attorney, Agent, or Firm*—Bacon & Thomas

[57] ABSTRACT

An insulating plate unit comprises a first engaging end and a second engaging end. The first fin extends longitudinally from an upper edge of the first engaging end and along a length of the upper edge. A first wing extends longitudinally from a lower edge of the first engaging end and along a length of the lower edge. The first wing extends to a distance greater than that of the first fin. The first wing has an inward facing surface and an outward facing surface. A channel is defined by the first fin and the first wing. A recess is formed in the outward facing surface and extends along the length of the lower edge of the first engaging end. A ridge is formed on the inward facing surface and extends along the length of the lower edge of the first engaging end. A groove is correspondingly formed in the second engaging end for engaging with the ridge of another insulating plate unit. The second engaging end is complimentary to the first engaging end so that the insulating plate units can be interconnected.

8 Claims, 4 Drawing Sheets

INSULATING PLATE UNIT

BACKGROUND OF THE INVENTION

The present invention relates to an insulating plate unit and, more particularly, to an insulating plate unit with improved engaging effect.

Insulating plate units have been used to constitute a wall or floor by interconnecting the units via engaging ends thereof. The tongue and groove engagement of the insulating plate units, however, is not sound enough to resist external forces applied to the engaging points. Furthermore, the insulating plate units cannot provide soundproof effects. Moreover, the insulating plate units provide no room for pipes for electric wires, gas, or water.

Therefore, there has been a long and unfulfilled need for an improved insulating unit to mitigate and/or obviate the aforementioned problems.

SUMMARY OF THE INVENTION

In accordance with an embodiment of the present invention, an insulating plate unit comprises a first engaging end and a second engaging end. A first fin extends longitudinally from an upper edge of the first engaging end and along a length of the upper edge. A first wing extends longitudinally from a lower edge of the first engaging end and along a length of the lower edge. The first wing extends to a distance greater than that of the first fin. The first wing has an inward facing surface and an outward facing surface. A channel is defined by the first fin and the first wing. A recess is formed in the outward facing surface and extends along the length of the lower edge of the first engaging end. A ridge is formed on the inward facing surface and extends along the length of the lower edge of the first engaging end. A groove is correspondingly formed in the second engaging end for engaging with the ridge of another insulating plate unit. The second engaging end is complimentary to the first engaging end so that the insulating plate units can be interconnected.

In accordance with another embodiment of the insulating plate unit, an extension projects from a lower edge of the first fin of the first engaging end, and the second engaging end is channeled at a corresponding section to fittingly receive the extension of another insulating plate unit.

In accordance with further embodiment of the insulating plate unit, a groove is formed in each of the inward facing surfaces instead of ridge and groove arrangement in the above-illustrated embodiment. A rib extends from a wall of the recess which is opposite to the associated channel, and the groove has an arcuate wall which faces the associated channel. Received in the groove is an engaging member which has a first end to be securely engaged in a space defined by the rib and a bottom wall of associated groove and a second end with a plurality of single direction retaining teeth which butt against the wall facing the groove, thereby preventing disengagement of two engaged plate units.

In accordance with another embodiment of the insulating plate unit, a conduit is provided in the groove not receiving the engaging member and/or in the channels.

Other advantages and novel features of the invention will become more apparent from the following detailed description when taken in conjunction with the accompanying drawings.

DETAILED DESCRIPTION OF THE PREFERRED EMBODIMENTS

Figure 1:
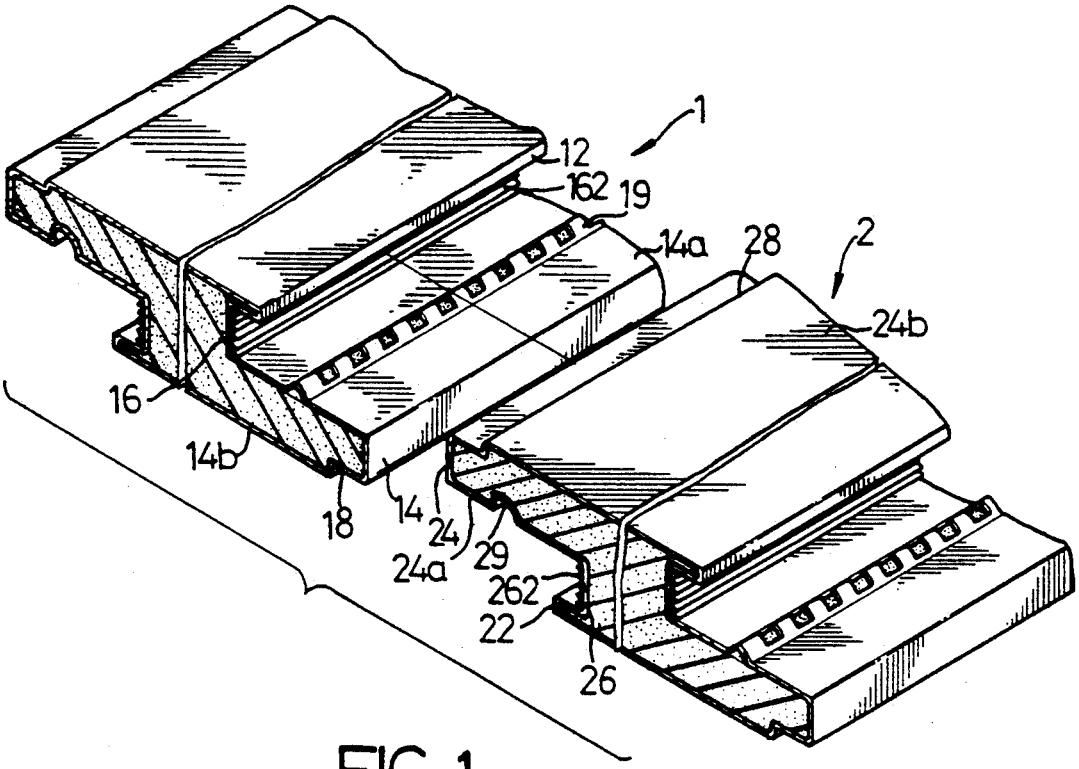
FIG. 1 is a perspective view of two insulating plate units in accordance with the present invention.
Figure 2:
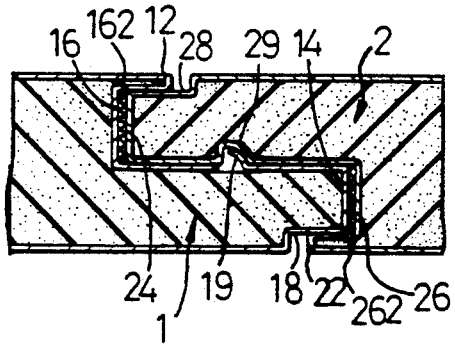
FIG. 2 is a partial side-elevational view showing the engaging ends of the insulating plate units in FIG. 1.

Referring to FIGS. 1 and 2, an insulating plate unit in accordance with the present invention generally includes a first engaging end 1 and a second engaging end 2. A first fin 12 extends longitudinally from an upper edge of the first engaging end 1 and along a length of the upper edge. A first wing 14 extends longitudinally from a lower edge of the first engaging end 1 and along a length of the lower edge. The first wing 14 extends to a distance greater than that of the first fin 12. The first wing 14 has an inward facing surface **14*a* and an outward facing surface 14*b*. A first channel 16 is defined by the first fin 12 and the first wing 14. A recess 18 is formed in the outward facing surface 14*b* and extends along the length of the lower edge of the first engaging end 1. Corresponding to the configuration of the first engaging end 1, a second fin 22 extends from a lower edge of the second engaging end 2 for engaging with the recess 18 of the first engaging end 1 of another insulating plate unit. A second wing 24 extends from an upper edge of the second engaging end in a manner the same as that of the first wing 14 relative to the first engaging end 1. The second wing 24 is received in the first channel 16 of the first engaging end 1 of another insulating plate unit. The second wing 24 has an inward facing surface 24*a* and an outward facing surface 24*b*. A second channel 26 is defined by the second fin 22 and the second wing 24 for receiving the first wing 14 of another insulating plate unit. A second recess 28 is formed in the outward facing surface 24*b* of the second wing 24 and extends along a length of the upper edge of the second wing 24. A ridge 19 is formed on the inward facing surface 14*a* and extends along the length of the lower edge of the first engaging end 1. A groove 29 is formed on and extends along a longitudinal length of the inward facing surface 24*a* of the second wing 24 for engaging with the ridge 19 of another insulating plate unit, thereby preventing from disengagement of the engaged plate units. Optionally, a resilient material 162, 262 may be provided in the respective channels 16, 26**.

Figure 3:
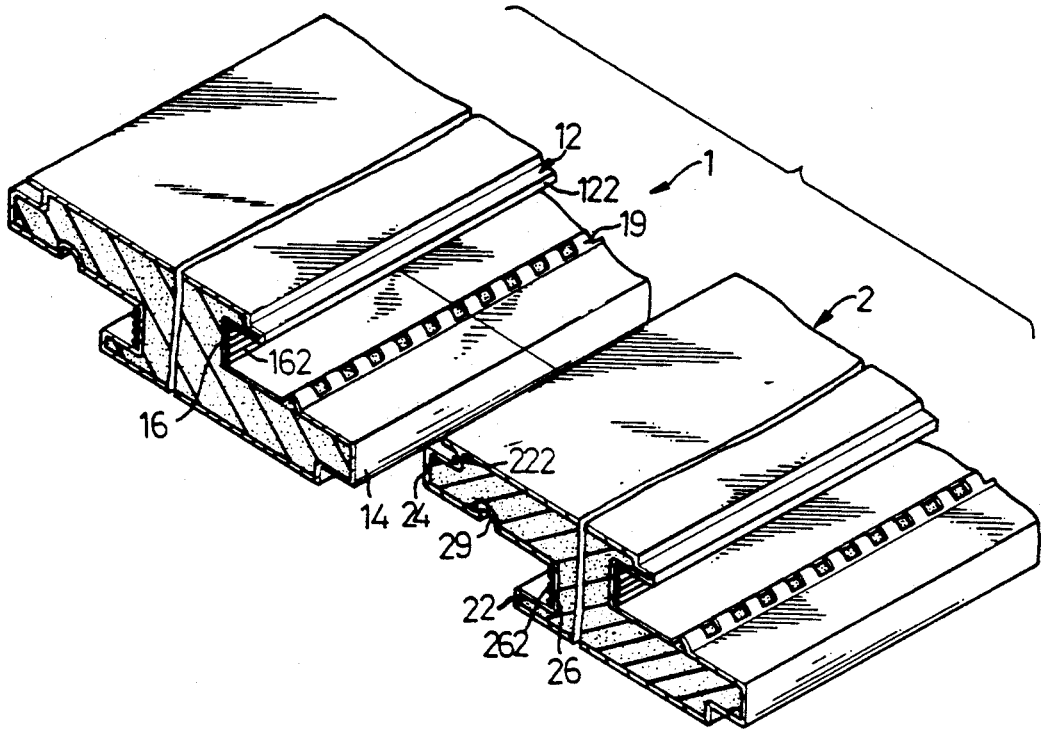
FIG. 3 is a perspective view of two insulating plate units of another embodiment in accordance with the present invention.
Figure 4:
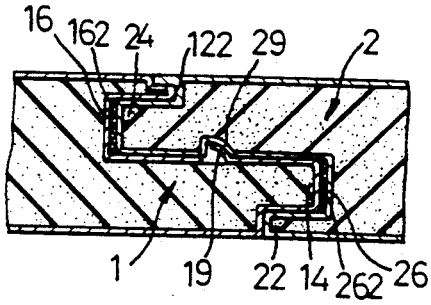
FIG. 4 is a partial side-elevational view showing the engaging ends of the insulating plate units in FIG. 3.

In accordance with another embodiment of the insulating plate unit, as shown in FIGS. 3 and 4, an extension 122 projects from a lower edge of the first fin 12 of the first engaging end and the second wing 24 is channeled (see 222) to fittingly receive the extension 122 of another insulating plate unit.

Figure 5:
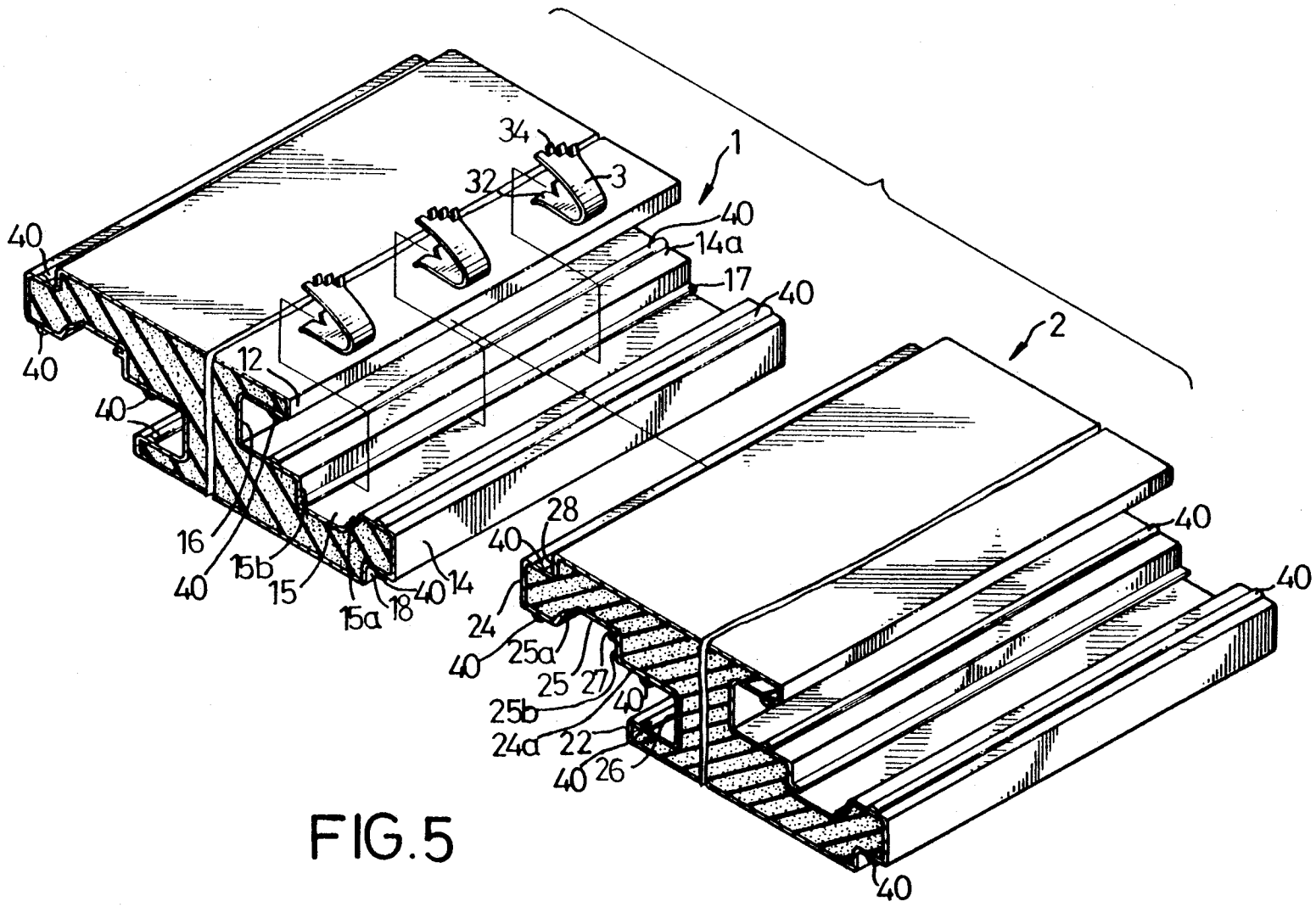
FIG. 5 is a perspective view of two insulating plate units in accordance with a further embodiment of the present invention.
Figure 6:
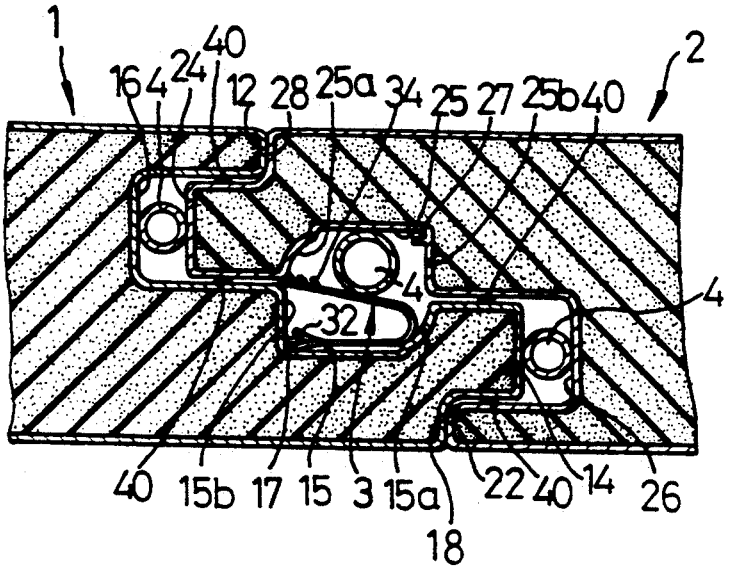
FIG. 6 is a partial side-elevational view showing the engaging ends of the insulating plate units in FIG. 5.

FIGS. 5 and 6 show a further embodiment of the insulating plate unit in which a groove 15, 25 is formed in each of the inward facing surfaces 14*a*, 14*b* instead of ridge and groove arrangement in the above-illustrated embodiment. In the first engaging end 1, the groove 15 has an arcuate wall 15*a* which faces associated channel 16 and a wall 15*b* which is opposite to the arcuate wall 15*a*. A rib 17 extends from the wall 15*b* of the groove 15. Received in one of the grooves 15 is an engaging member 3 which has a substantially V-shaped first end 32 to be securely engaged in a space defined by the rib 17 and a bottom wall of the groove 15 and a second end with a plurality of single direction retaining teeth 34 which butt against the arcuate wall 25*a* of another insulating plate unit, thereby preventing disengagement of engaged plate units, as shown in FIG. 6. In the second engaging end 2, the groove 25 also has an arcuate wall 25*a* which faces associated channel 26 and a wall 25*b* which is opposite to the arcuate wall 25*a*. A rib 27 extends from the wall 25*b* of the groove 25. In FIG. 6, only one engaging member 3 is provided in groove 15, yet in FIG. 7, a further engaging member 3 is provided in groove 25.

As shown in FIG. 5, on the first engaging end 1, strips 40 of resilient material may be respectively provided on the underside of the first fin 12, the inward facing surface 14*a* of the first wing 14, and the recess 18 in the outward facing surface 14*b*. Correspondingly, on the second engaging end 2, strips 40 of resilient material may be provided on the recess 28 in the outward facing surface 24*b*, the inward facing surface 24*a* of the second wing 24, and the underside of the second fin 22, providing a sound-proof effect.

Figure 7:
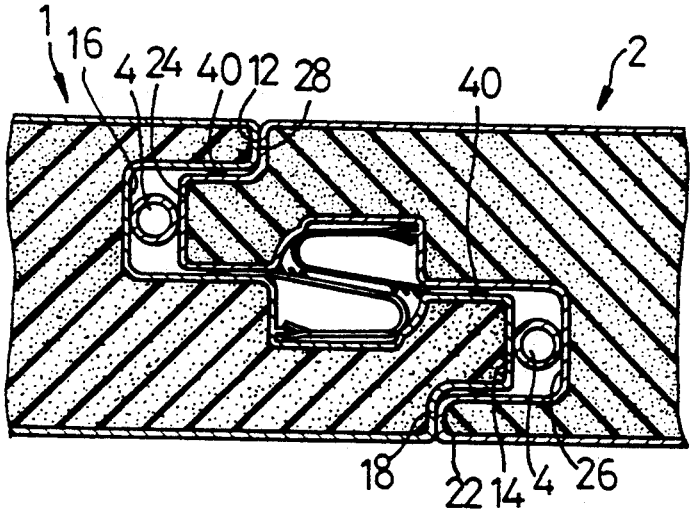
FIG. 7 is a partial side-elevational view similar to FIG. 6, showing still another embodiment of the present invention.

In accordance with another embodiment of the insulating plate unit, a conduit 4 for fluid communication, electricity conduction, or other application is provided in the groove 25 which does not receive the engaging member 3 (see FIG. 6) and/or in the channels 16, 26. It is appreciated that the conduit 4 may also be provided in the channels 16, 26 in FIGS. 1 through 4 which merely requires a space preset in the channels 16, 26 as shown in FIG. 7.

Although the invention has been explained in relation to its preferred embodiment, it is to be understood that many other possible modifications and variations can be made without departing from the spirit and scope of the invention as hereinafter claimed.

I claim:

1. An insulating plate unit comprising;

a first engaging end (1) and a second engaging end (2), a first fin (12) extending longitudinally from an upper edge of said first engaging end (1) and along a length of said upper edge, a first wing (14) extending longitudinally from a lower edge of said first engaging end (1) and along a length of said lower edge, said first wing (14) extending to a distance greater than that of said first fin (12), said first wing 14 having an inward facing surface (14*a*) and an outward facing surface (14*b*), a ridge (19) being formed on said inward facing surface (14*a*) and extending along the length of said lower edge of said first engaging end (1), a first channel (16) being defined by said first fin (12) and said first wing (14), a first excess (18) being formed in said outward facing surface (14*b*) and extending along the length of said lower edge of said first engaging end (1), a second fin (22) extending from a lower edge of said second engaging end (2) for engaging with the first recess (18) of the first engaging end (1) of another insulating plate unit, a second wing (24) extending from an upper edge of said second engaging end (2) in a manner the same as that of said first wing (14) relative to said first engaging end (1), said second wing (24) being received in the first channel (16) of the first engaging end (1) of another insulating plate unit, said second wing (24) having an inward facing surface (24*a*) and an outward facing surface (24*b*), a groove (29) being formed in and extending along a longitudinal length of said inward facing surface (24*a*) of said second wing (24) for engaging with the ridge (19) of another insulating plate unit, a second channel (26) being defined by said second fin (22) and said second wing (24) for receiving the first wing (14) of another insulating plate unit, and a second recess (28) being formed in said outward facing surface (24*b*) of said second wing (24) and extending along a length of said upper edge of said second wing (24).

2. The insulating plate unit as claimed in claim 2 wherein an elastic material (162, 262) is provided in said channel (16, 26).

3. An insulating plate unit comprising:

a first engaging end (1) and a second engaging end (2), a first fin (12) extending longitudinally from an upper edge of said first engaging end (1) and along a length of said upper edge, an extension (122) projecting from a lower edge of said first fin (12), a first wing (14) extending longitudinally from a lower edge of said first engaging end (1) and along a length of said lower edge, said first wing (14) extending to a distance greater than that of said first fin (12), said first wing (14) having an inward facing surface (14*a*) and an outward facing surface (14*b*), a first channel (16) being defined by said first fin (12) and said first wing (14), a first recess (18) being formed in said outward facing surface (14*b*) and extending along the length of said lower edge of said first engaging end (1).

a second fin (22) extending from a lower edge of said second engaging end (2) for engaging with the first recess (18) of the first engaging end (1) of another insulating plate unit, a second wing (24) extending from an upper edge of said second engaging end (2) in a manner the same as that of said first wing (14) relative to said first engaging end (1), said second wing (24) being received in the first channel (16) of the first engaging end (1) of another insulating plate unit, said second wing (24) having an inward facing surface (24*a*) and an outward facing surface (24*b*), said second wing (24) being channeled to fittingly receive the extension (122) of the first fin (12) of another insulating plate unit, a second channel (26) being defined by said second fin (22) and said second wing (24) for receiving the first wing (14) of another insulating plate unit, and a second recess (28) being formed in said outward facing surface (24*b*) of said second wing (24) and extending along a length of said upper edge of said second wing (24).

4. An insulating plate unit comprising:

a first engaging end (1) and a second engaging end (2), a first fin (12) extending longitudinally from an upper edge of said first engaging end (1) and along a length of said upper edge, a first wing (14) extending longitudinally from a lower edge of said first engaging end (1) and along a length of said lower edge, said first wing (14) extending to a distance greater than that of said first fin (12), said first wing (14) having an inward facing surface (14*a*) and an outward facing surface (14*b*), a first channel (16) being defined by said first fin (12) and said first wing (14), a first recess (18) being formed in said outward facing surface (14*b*) and extending along the length of said lower edge of said first engaging end (1), a second fin (22) extending from a lower edge of said second engaging end (2) for engaging with the first recess (18) of the first engaging end (1) of another insulating plate unit, a second wing (24) extending from an upper edge of said second engaging end (2) in a manner the same as that of said first wing (14) relative to said first engaging end (1), and second wing (24) being received in the first channel (16) of the first engaging end (1) of another insulating plate unit, said second wing (24) having an inward facing surface (24*a*) and an outward facing surface (24*b*), a second channel (26) being defined by said second fin (22) and said second wing (24) for receiving the first wing (14) of another insulating plate unit, a conduit (4) is received in at least one of said channels (16, 26), and a second recess (28) being formed in said outward facing surface (24*b*) of said second wing (24) and extending along a length of said upper edge of said second wing (24).

5. An insulating plate unit comprising:

a first engaging end (1) and a second engaging end (2), a first fin (12) extending longitudinally from an upper edge of said first engaging end (1) and along a length of said upper edge, a first wing (14) extending longitudinally from a lower edge of said first engaging end (1) and along a length of said lower edge, said first wing (14) extending to a distance greater than that of said first fin (12), said first wing (14) having an inward facing surface (14*a*) and an outward facing surface (14*b*), a first channel (16) being defined by said first fin (12) and said first wing (14), a first recess (18) being formed in said outward facing surface (14*b*) and extending along the length of said lower edge of said first engaging end (1), a second fin (22) extending from a lower edge of said second engaging end (2) for engaging with the first recess (18) of the first engaging end (1) of another insulating plate unit, a second wing (24) extending from an upper edge of said second engaging end (2) in a manner the same as that of said first wing (14) relative to said first engaging end (1), said second wing (24) being received in the first channel (16) of the first engaging end (1) of another insulating plate unit, said second wing (24) having an inward facing surface (24*a*) and an outward facing surface (24*b*), a second channel (26) being defined by said second fin (22) and said second wing (24) for receiving the first wing (14) of another insulating plate unit, and a second recess (28) being formed in said outward facing surface (24*b*) of said second wing (24) and extending along a length of said upper edge of said second wing (24);

a groove (15, 25) being formed in each of said inward facing surfaces (14*a*, 24*a*), said groove (15, 25) having an arcuate wall (15*a*, 25*a*) which faces associated channel (16, 26) and a wall (15*b*, 25*b*) which is opposite to said arcuate wall (15*a*,25*a*), a rib (17, 27) extending from said wall (15*b*, 25*b*) of said groove (15, 25), an engaging member (3) being received in at least one of said groove (15, 25) and having a substantially V-shaped first end (32) to be securely engaged in a space defined by said rib (17, 27) and a bottom wall of said groove (15, 25) and a second end with a plurality of single direction retaining teeth (34) which butt against said arcuate wall (15*a*, 25*a*) of another insulating plate unit, thereby preventing disengagement of engaged plate units.

6. The insulating plate unit as claimed in claim 6 wherein said groove (15, 25) which does not receive said engaging member (3) receives a conduit (4)

7. The insulating plate unit as claimed in claim 6 wherein a conduit (4) is received in at least one of said channels (16, 26).

8. The insulating plate unit as claimed in claim 6 wherein on said first engaging end (1), strips (40) of resilient material are respectively provided on an underside of said first fin (12), said inward facing surface (14*a*) of said first wing (14), and said recess (18) in said outward facing surface (14*b*), and on said second engaging end (2), strips (40) of resilient material are provided on said recess (28) in said outward facing surface (24*b*), said inward facing surface (24*a*) of said second wing (24), and an underside of said second fin (22), providing a sound-proof effect.

* * * * *